United States Patent [19]

Blessing et al.

[11] 4,192,243

[45] Mar. 11, 1980

[54] SEWING MACHINE THREAD MONITOR

[75] Inventors: Hubert Blessing, Dallas; Gaylord D. Allison, Plano, both of Tex.

[73] Assignee: Levi Strauss & Co., San Francisco, Calif.

[21] Appl. No.: 947,451

[22] Filed: Oct. 2, 1978

[51] Int. Cl.[2] ..... G06M 3/02; D05B 69/36

[52] U.S. Cl. ..... 112/273; 235/92 PD

[58] Field of Search ..... 112/273, 275, 277, 278; 235/92 PD, 92 BD, 92 PE, 92 R, 92 DN, 92 CT, 132 E; 66/125 R

[56] References Cited

U.S. PATENT DOCUMENTS

| | | | |
|---|---|---|---|
| 3,352,267 | 11/1967 | Brandrift et al. | 112/278 |
| 3,832,960 | 9/1974 | Mayer et al. | 112/277 |
| 3,928,752 | 12/1975 | Darwin | 112/273 X |
| 4,038,617 | 7/1977 | Milom | 235/92 PD |

*Primary Examiner*—Werner H. Schroeder
*Assistant Examiner*—Andrew M. Falik
*Attorney, Agent, or Firm*—Limbach, Limbach & Sutton

[57] ABSTRACT

The apparatus counts the number of stitches made by a sewing machine, counts the number of predetermined lengths of thread needed to make those stitches and outputs an alarm signal when the number of stitches per thread length either exceeds a predetermined number or is less than a predetermined number.

6 Claims, 5 Drawing Figures

SEWING MACHINE THREAD MONITOR

BACKGROUND OF THE INVENTION

This invention pertains to thread monitoring apparatus for a sewing machine and more particularly to apparatus for monitoring the amount of thread consumed in producing a predetermined number of stitches.

It is desirable in operating a commercial sewing machine, and in particular an automated or semi-automated commercial sewing machine, to monitor the thread consumption to detect whether the machine is making stitches which are too close together, too far apart or whether the thread has broken, for example.

SUMMARY OF THE INVENTION

Such a sewing machine thread monitoring apparatus is provided by the present invention which comprises stitch sensor means connected to the sewing machine for generating a predetermined number of electrical pulses, referred to herein as stitch pulses, for each stitch made by the sewing machine, thread sensor means for measuring the consumption of thread and for generating a pulse, referred to herein as a thread length pulse for each predetermined length of thread consumed, and a resetable, up/down counter containing a preloaded count and having as its clock input the stitch pulses and as its reset input the thread pulses so that an output signal is generated whenever the number of stitch pulses counted exceeds the preloaded count by a predetermined amount before the counter is reset to the preloaded count by the receipt of a thread length pulse. In the preferred embodiment of the invention the output signal triggers an indicator or stops the sewing machine.

In one embodiment the counter subtracts the stitch pulses from the preloaded count and produces the output signal when the counter reaches zero. This embodiment is used for monitoring low thread consumption. In another embodiment the counter adds the received stitch pulses to the preloaded count and produces the counter output signal whenever the counter reaches the carryout condition. This embodiment is used to monitor high thread consumption.

The stitch sensor comprises a target mounted on the main drive shaft of the sewing machine and a detector for sensing the passage of the target by the detector so that an electrical pulse is generated each time the target passes the detector. Similarly the thread pulse sensor comprises a wheel upon which the thread is wrapped and upon which a target is mounted. A separate detector senses the movement of the thread wheel target and generates a pulse per each revolution of the thread wheel, thereby measuring out a predetermined length of thread, corresponding to the circumference of the wheel, as the thread is consumed.

It is therefore an object of the present invention to provide apparatus for monitoring the amount of thread consumed to produce a predetermined number of stitches.

It is still another object of the invention to monitor the amount of thread consumed to producing a predetermined number of stitches and for activating an alarm or otherwise providing an indication that the amount of thread being consumed deviates from a predetermined standard consumption.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENT

Figure 1:
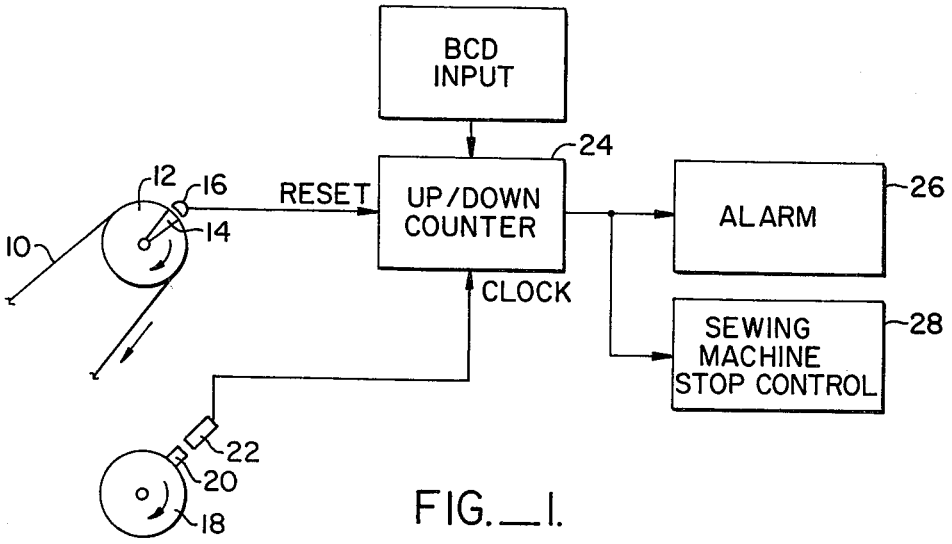
FIG. 1 is a schematic illustration of the thread monitor of the invention.

Referring now to FIG. 1, in order to measure the amount of thread consumed, thread 10, which is supplied either to the bobbin or the needle, is wrapped around a wheel 12 having a target 14 mounted thereon. Target 14 can be, for example, a piece of magnetic material, a color coded symbol or a reflective target, etc. A detector 16 is mounted close to the circumference of the wheel 12 to sense the passage of the target 14 past the sensor 16 as the wheel 12 rotates due to the travel of the moving thread around the circumference of the wheel. Thus, the measured length of thread is given by the relationship of $L=2\pi R/n$ where L is the length of thread, R is the radius of the wheel, and n is the number of impulses per revolution. It should be understood that while one target 14 has been illustrated for use with the wheel 12 it is also possible to place a number of targets at circumferentially spaced apart positions on the wheel 12 to divide the revolution of the wheel into segments.

The sewing machine shaft also has mounted on it a target 20, which again can take a variety of different forms, and whose passage with each revolution of the shaft 18 is sensed by a detector 22. The detector 22 will give a pulse for each target mounted on the shaft of the sewing machine per each revolution of the shaft. In the conventional machine one revolution of the sewing machine shaft produces one stitch so that the number of pulses produced per stitch is equal to the number of targets on the sewing machine shaft.

The pulse output from the detector 16, which hereinafter will be referred to as the thread pulse, is supplied to the reset input of a resetable, up/down, electronic counter 24. The electrical pulse output from the detector 22, which will be referred to hereinafter as the stitch pulse, is supplied to the clock input of the up/down counter 24. The up/down counter 24 can be preloaded from a BCD (binary coded decimal) input to the counter. Each time the counter is reset by the receipt of a thread pulse from the detector 16 the BCD preloaded number is also placed into the up/down counter.

In the countdown condition the counter 24 starts counting toward zero from the preload number with the receipt of each stitch pulse. The preloaded number is selected to be high enough such that when the machine is making the correct number of stitches per measured length of thread the counter never quite gets to zero before it is reloaded with the preload number by the receipt at the reset input of a thread pulse from the detector 16. However, should the counter reach zero an output pulse is generated which is supplied to an alarm 26 or a sewing machine stop control 28. Therefore, if the consumption of thread decreases sufficiently, as will happen in the case of a broken thread or a dropped stitch, the counter will reach zero and generate an output pulse. The output pulse triggers the alarm 26 and stops the sewing machine through the sewing machine stop control 28. Other forms of low thread usage are also detected by this system.

High thread usage can be detected by setting the up/down counter to count up and preloading the counter with a number high enough so that the counter almost reaches the "carryout" condition before being reloaded. Should the counter reach the carryout condition before a thread pulse is received the output pulse will be generated to sound the alarm and stop the sewing machine through stop control 28.

In both the countup and countdown configurations the preloaded number is chosen sufficiently large so that the number of stitch pulses which are expected to be counted will not exceed the preloaded count by more than some predetermined amount. In the countdown mode this predetermined amount is zero.

Figure 5:
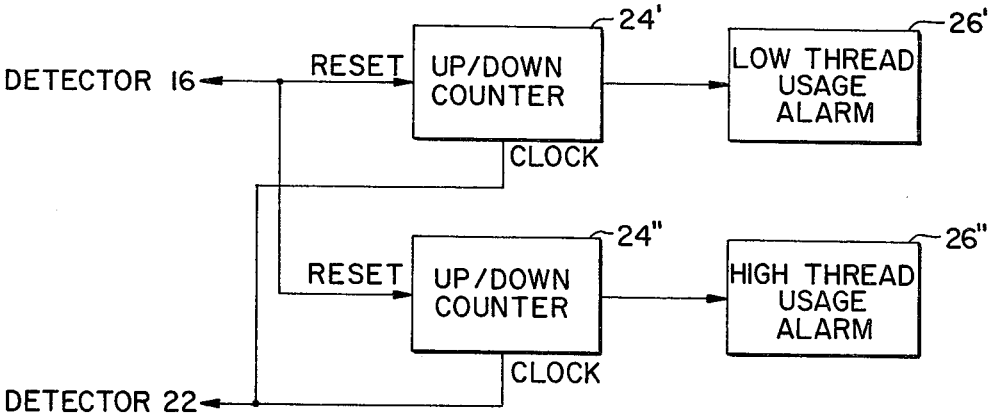
FIG. 5 is a schematic illustration of a modification of the embodiment depicted in FIG. 4.

A combination of both systems, that is one counter 24' set to count down and another counter 24" set to count up can be used to bracket the thread usage, as depicted in FIG. 5. This allows a continuous monitoring of the stitch quality. It will be understood that all that is required to have such a "bracket" system is to have either a dual up/down counter which receives the thread and stitch pulses and simultaneously counts up and down in two separate counters to provide two separate output pulses to separate sets of alarms and stop controls or by having two physically separate systems.

Figure 2:
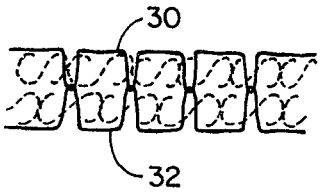
FIG. 2 is a diagrammatic illustration of a correct lock stitch for use in explaining the operation of the invention.
Figure 3:
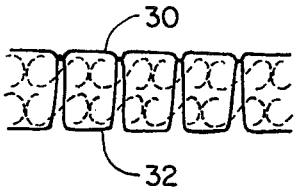
FIG. 3 is a diagrammatic illustration of a lock stitch in the situation where the needle thread has more tension than the bobbin thread, resulting in low usage of the needle thread.
Figure 4:
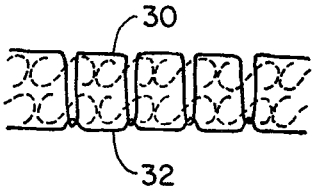
FIG. 4 is a diagrammatic illustration of a lock stitch where the tension of the needle thread is less than the tension of the bobbin thread, resulting in high usage of the needle thread.

An example of the usage of this system is illustrated in FIGS. 2 through 4. In FIG. 2 a correct lock stitch is diagrammatically shown. In this illustration the upper thread 30 corresponds to the needle thread and the lower thread 32 corresponds to the bobbin thread. FIG. 3 illustrates the condition where the needle thread 30 is supplied under more tension than the bobbin thread 32 resulting in low usage of the needle thread. This condition would be detected by the low usage counter, that is when the counter 24 is set to count down from the preloaded number until the counter is reloaded by the receipt of a thread pulse signal at the reset input. FIG. 4 illustrates the condition where the tension of the needle thread 30 is less than the tension of the bobbin thread 32, resulting in a high usage of the needle thread. This condition would be detected by setting the counter 24 to count up. While it is theoretically possible to have the same type of detection system, for example a low usage counter, to separately monitor the needle thread 30 and the bobbin thread 32, in the case of a lock stitch sewing machine, the needle thread is the only thread which can be monitored because the bobbin thread is not accessible.

Although a lock stitch is used for purposes of illustration, it should be understood that the method and apparatus of monitoring stitch quality as described above may be used with other types of stitches since other stitches generate an even larger difference in thread consumption if the stitch is faulty. In this discussion, the counters have also been counting the number of stitches per length of thread. For greater accuracy, the number of partial stitches per length can be used. This is accomplished by putting multiple targets on the sewing machine shaft to cause the detector to produce multiple pulses per stitch. Similarly, multiple targets could be added to the thread measuring wheel. A separate counter could also be added to use more than one rotation of the thread measuring wheel where it is desired to lengthen the amount of thread which is monitored and consumed in making a predetermined number of stitches. For example, if the output from the detector 16 is supplied to a single flip-flop the output of the flip-flop produces a pulse to preload or reset the counter 24 for every two revolutions of the thread measuring wheel.

While in the above described embodiment the counter only triggers an alarm system 26 and a sewing machine stop control 28 it should be apparent that the output of the up/down counter can be fed to the input of a simple servo system to automatically adjust thread tension by sensing over or under use of one or more of the threads forming the stitches. Since such a servo system is well understood by those skilled in the art its details will not be described.

The terms and expressions which have been employed here are used as terms of description and not of limitation, and there is no intention, in the use of such terms and expressions of excluding equivalents of the features shown and described, or portions thereof, it being recognized that various modifications are possible within the scope of the invention as claimed.

What is claimed is:

1. Sewing machine apparatus for monitoring the number of sewing stitches made per measured length of thread consumed in making the stitches, the apparatus comprising stitch sensor means connected to the sewing machine for generating a predetermined number of electrical pulses ("stitch pulses") for each stitch made by the sewing machine, thread sensor means for measuring the consumption of thread and for generating a pulse ("thread length pulse") for each predetermined length of thread consumed, a counter containing a preloaded count and having a reset input, a clock input, and an output, the clock input being connected to the stitch sensor means to receive the stitch pulses, the reset input being connected to the thread sensor means for receiving the thread length pulses and wherein the counter generates an output signal whenever the number of stitch pulses counted exceeds the preloaded count by a predetermined amount before the counter is reset to the preloaded count upon the receipt of a thread length pulse.

2. Sewing machine monitoring apparatus as recited in claim 1 further comprising an indicator which is triggered by the counter output signal.

3. Sewing machine monitoring apparatus as recited in claim 1 wherein the counter includes means for subtracting the received stitch pulses from the preloaded count and for producing the output signal when the counter reaches zero.

4. Sewing machine monitoring apparatus as recited in claim 1 wherein the counter includes means for adding the received stitch pulses to the preloaded count and for producing the counter output signal when the counter reaches the "carry out" condition.

5. Sewing machine monitoring apparatus as recited in claim 1 comprising at least a pair of such counters, and wherein one of the counters subtracts the received stitch pulses from the preloaded count and produces a first output signal when the counter reaches zero and the other counter adds the received stitch pulses to the preloaded count and produces a second output signal when the counter reaches the "carryout" condition.

6. Apparatus for monitoring the stitches of a sewing machine of the type having a main drive shaft and a supply of sewing thread, the apparatus comprising stitch-pulse generation means connected to the main drive shaft to generate electrical pulses as a function of the cyclical movement of the sewing machine drive shaft, thread-pulse generating means for measuring the consumption of sewing thread and for generating an electrical pulse per each predetermined length of thread as it is consumed, counter means for comparing the number of stitches taken with the length of sewing thread consumed in making that number of stitches, the counter means including a counter having a preload input for loading a selected number into the counter upon the receipt of a pulse at the preload input, a clock input for receiving pulses to be counted by counter means, and means for comparing the counted pulses with the preloaded number and for generating an output signal when the pulse count exceeds the preloaded number and wherein the preload input is connected to the thread-pulse generating means and the clock input is connected to the stitch-pulse generating means, and means supplied with the counter means output signal for indicating that the expected thread consumption per stitch has varied from a predetermined value as represented by the preloaded number in the counter means.

* * * * *